US008657391B2

(12) United States Patent
Simondi et al.

(10) Patent No.: US 8,657,391 B2
(45) Date of Patent: Feb. 25, 2014

(54) MERCHANDISE DISPLAY SYSTEM AND METHOD

(75) Inventors: Rudy Simondi, Golden Valley, MN (US); Debra Hovel, Hopkins, MN (US); Richard Hovel, Hopkins, MN (US)

(73) Assignee: Rubicon, Inc., Golden Valley, MN (US)

( * ) Notice: Subject to any disclaimer, the term of this patent is extended or adjusted under 35 U.S.C. 154(b) by 0 days.

(21) Appl. No.: 13/173,443

(22) Filed: Jun. 30, 2011

(65) Prior Publication Data

US 2012/0001526 A1 Jan. 5, 2012

Related U.S. Application Data

(60) Provisional application No. 61/360,807, filed on Jul. 1, 2010.

(51) Int. Cl.
*A47B 81/00* (2006.01)

(52) U.S. Cl.
USPC ..... 312/234.1; 312/118; 211/34

(58) Field of Classification Search
USPC ..... 312/234.1, 234.5, 234, 117, 118, 128, 312/132, 234.2, 35, 119, 122, 120, 121, 312/234.4; 211/34–37, 57.1, 45, 46, 50
See application file for complete search history.

(56) References Cited

U.S. PATENT DOCUMENTS

| | | | | | |
|---|---|---|---|---|---|
| 1,132,190 | A | * | 3/1915 | Kohout | 211/85.3 |
| 1,662,885 | A | * | 3/1928 | Dell | 312/300 |
| 1,829,995 | A | * | 11/1931 | Lineberger | 312/120 |
| 2,430,635 | A | * | 11/1947 | Glass | 312/119 |
| 3,602,562 | A | * | 8/1971 | Radelfinger | 312/119 |
| 3,942,852 | A | * | 3/1976 | Anthony | 312/294 |
| 4,624,060 | A | | 11/1986 | Maxwell | |
| 4,823,962 | A | | 4/1989 | Arias | |
| 4,925,038 | A | * | 5/1990 | Gajewski | 211/59.2 |
| 5,282,553 | A | * | 2/1994 | Ibled | 223/85 |
| 5,553,724 | A | * | 9/1996 | Moher et al. | 211/70.7 |
| 5,911,347 | A | * | 6/1999 | Jackstat et al. | 223/85 |
| 5,931,314 | A | * | 8/1999 | Jackstat et al. | 211/34 |
| 6,041,948 | A | * | 3/2000 | Filipak et al. | 211/85.1 |
| 6,402,105 | B1 | | 6/2002 | Hoyt et al. | |
| 6,467,856 | B1 | * | 10/2002 | Chang et al. | 312/108 |
| 6,497,329 | B1 | * | 12/2002 | Johnson et al. | 211/128.1 |
| 6,612,430 | B1 | | 9/2003 | Silvera | |
| 6,948,622 | B2 | | 9/2005 | Brownfield et al. | |
| 6,976,595 | B1 | * | 12/2005 | Geller | 211/94.01 |
| D570,679 | S | | 6/2008 | Emery | |
| 7,478,732 | B2 | * | 1/2009 | Brownfield et al. | 211/85.26 |
| 8,038,019 | B2 | * | 10/2011 | Wagner | 211/60.1 |
| 2009/0071917 | A1 | | 3/2009 | Hathorn | |
| 2011/0240576 | A1 | * | 10/2011 | Abbruzzese et al. | 211/85.3 |

* cited by examiner

*Primary Examiner* — Daniel Rohrhoff
(74) *Attorney, Agent, or Firm* — Thomas J. Oppold; Larkin Hoffman Daly & Lindgren Ltd.

(57) ABSTRACT

A merchandise display system and method which promotes self-service by customers. The system includes plurality of cabinets each having a top surface and a plurality of pull-out racks. The top surface has a plurality of display areas corresponding to the plurality of pull-out racks. Each display area and a corresponding rack is marked with a matching identifying indicia. A merchandise sample is provided for each display area and is also conspicuously marked with matching identifying indicia. An inventory of merchandise removably hangs from each of the plurality of racks having the same features as the corresponding merchandise sample. A consumer viewing a desired merchandise sample on display can easily locate the corresponding inventory of merchandise by matching the identifying indicia of the desired sample with the rack supporting the corresponding inventory of merchandise.

18 Claims, 5 Drawing Sheets

MERCHANDISE DISPLAY SYSTEM AND METHOD

BACKGROUND

Various systems and methods have been devised to promote self-service by shoppers when visiting a store so as to minimize employees and reduce overhead. However, all too often, the reduction in employees and the desire to reduce overhead often results in sacrificing the shopping experience of the consumer. This can effect store revenues because consumers will be less inclined to visit a store if they have previously had a poor or unpleasant shopping experience at that store.

Accordingly there is a need for a merchandise display system and method that minimizes employees and reduces overhead costs while at the same time improving the consumer's shopping experience.

DESCRIPTION

Figure 1:
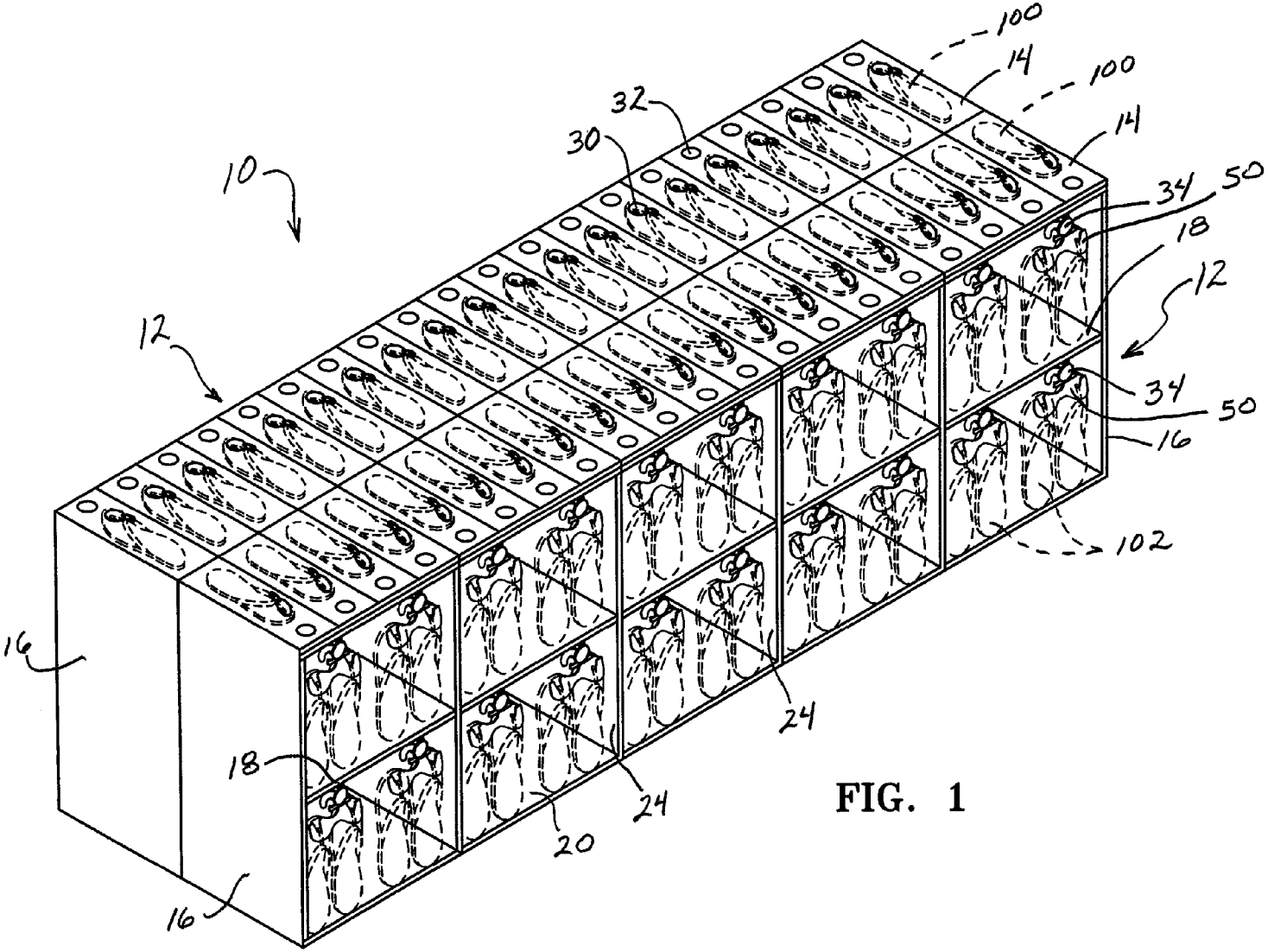
FIG. 1 is a perspective view of one embodiment of a footwear display system and method in accordance with the present invention.

Referring now to the drawings, wherein like reference numerals designate identical or corresponding parts throughout the several views, FIG. 1 illustrates one embodiment of a merchandise display system and method 10. The display system and method 10 is particularly adapted for footwear, such as sandals, but it should be appreciated that the system and method 10 may be equally applicable for any other type of merchandise that is suitable for self-service shopping by consumers whereby the consumer is permitted to browse and select from the store's inventory an item of a particular size or an item having a particular desired feature or characteristic. Accordingly, although specific reference may be made to "sandals" or "footwear" throughout the specification and appended claims, it should be understood that such terms are intended to include within their scope any item of merchandise unless clearly stated otherwise.

The system and method 10 utilizes a cabinet 12 having a top surface 14 on which a plurality of merchandise samples 100 are displayed. In FIG. 1, two cabinets 12 are shown positioned back-to-back. One or more pull-out racks 50 are disposed below the top surface 14 of the cabinet 12 from which a plurality of merchandise inventory 102 corresponding to the merchandise samples 100 removably hangs for selection and purchase by shoppers. The cabinet 12 may be of any desired dimension and construction which may vary by personal aesthetic preference, by the size or arrangement of the store in which the system and method 10 is used, by the number, size and types of merchandise samples 100 to be displayed, by the desired quantity of merchandise inventory 102 to be available to shoppers, and various other desired design features and variables. The cabinet preferably includes sidewalls 16, a horizontal shelf 18, a backwall 20 (FIG. 5), a bottom panel 22 (FIG. 5) and, depending on the length of the cabinet, one or more internal vertical support panels 24 as necessary or desired.

Figure 2:
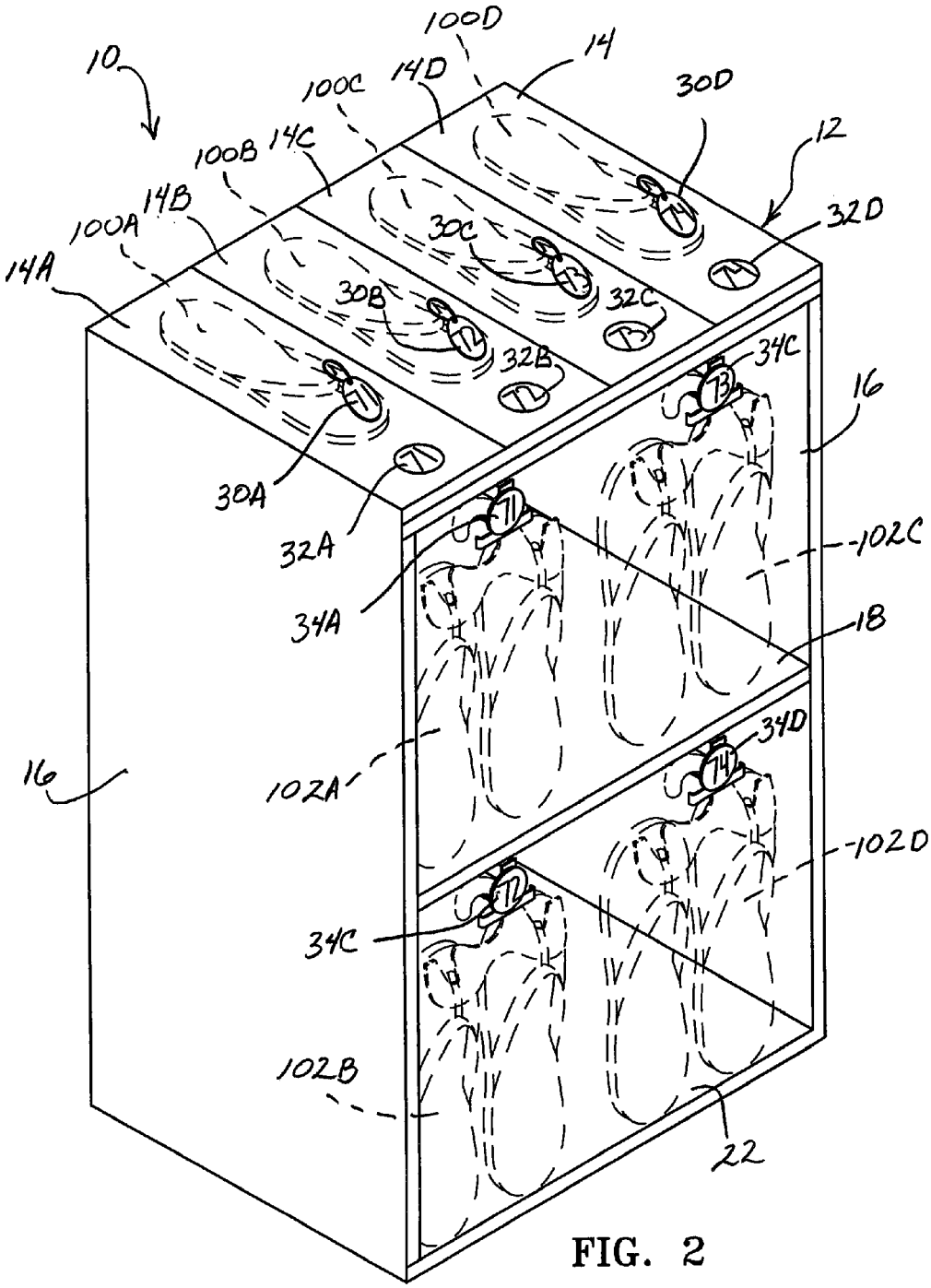
FIG. 2 is a detailed perspective view of an embodiment of a cabinet for the footwear display system and method of FIG. 1.

FIG. 2 is a detailed perspective view of a preferred embodiment of the system and method 10. As illustrated, the top surface 14 of the cabinet 12 is preferably divided into four equally spaced display areas 14A, 14B, 14C, 14D. Within each of the respective display areas there is on display, a different sandal brand or style sample 100A, 100B, 100C, 100D. Each of the four pull-out racks 50 supports a corresponding sandal inventory 102A, 102B, 102C, 102D for each of the respective sandal brand or style samples 100A, 100B, 100C, 100D on display in the display areas 14A, 14B, 14C, 14D. To ensure that the sandal samples 100A, 100B, 100C, 100D and the corresponding inventory 102A, 102B, 102C, 102D are easily identifiable by shoppers and to ensure the sandal samples 100A, 100B, 100C, 100D remain in the correct display area 14A, 14B, 14C, 14D, a large tag 30A, 30B, 30C, 30D is secured to the samples 100A, 100B, 100C, 100D which corresponds to a large matching button 32A, 32B, 32C, 32D secured to the display areas 14A, 14B, 14C, 14D which corresponds to a large matching tab 34A, 34B, 34C, 34D secured to the racks 50 supporting the corresponding inventory 102A, 102B, 102C, 102D. The tags, buttons and tabs 30, 32, 34 are preferably brightly colored and include large identifying indicia (such a sequentially numbered digits) that can be easily read and matched.

Figure 3:
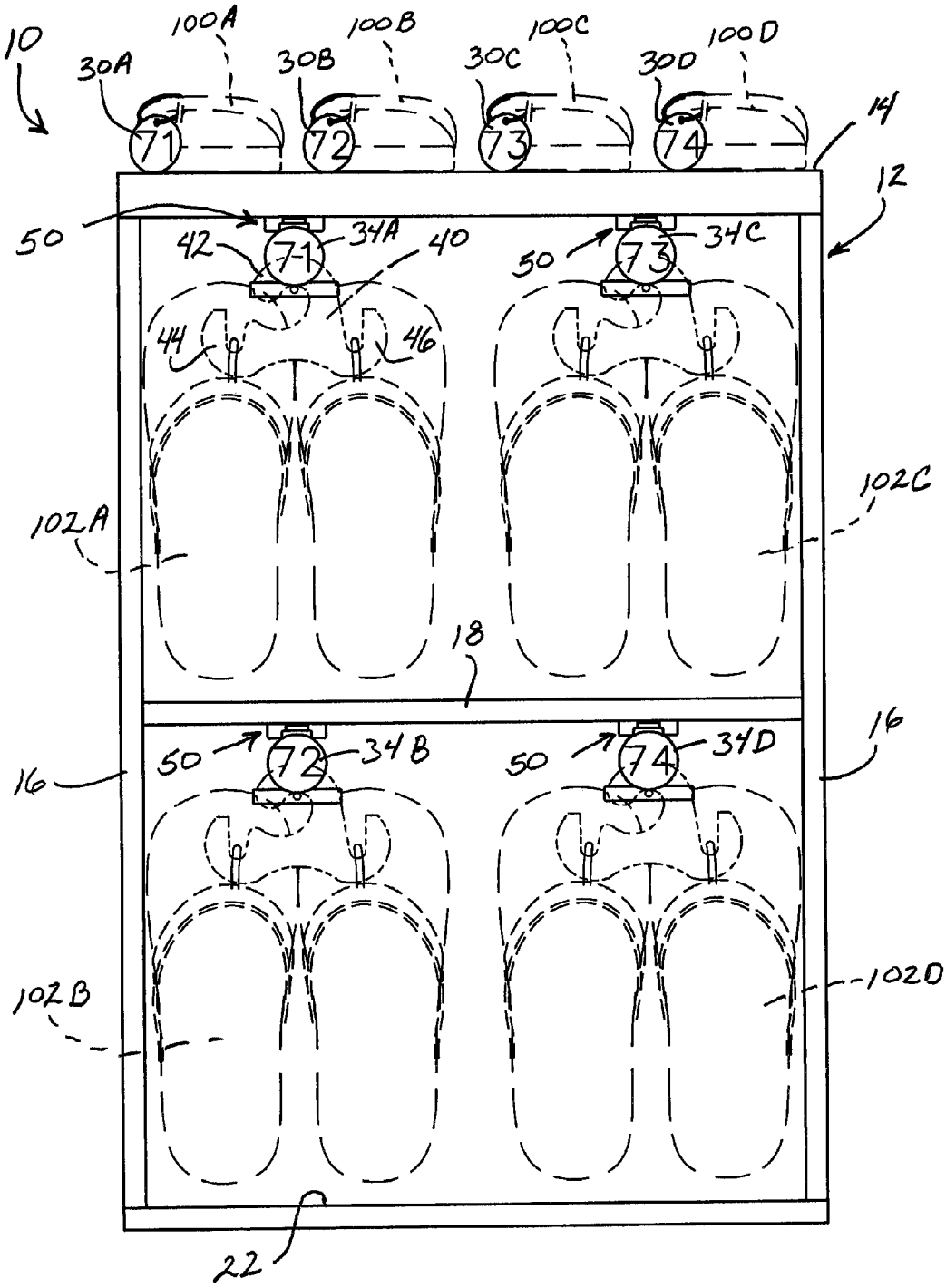
FIG. 3 is a front elevation view of the cabinet of FIG. 2.
Figure 4:
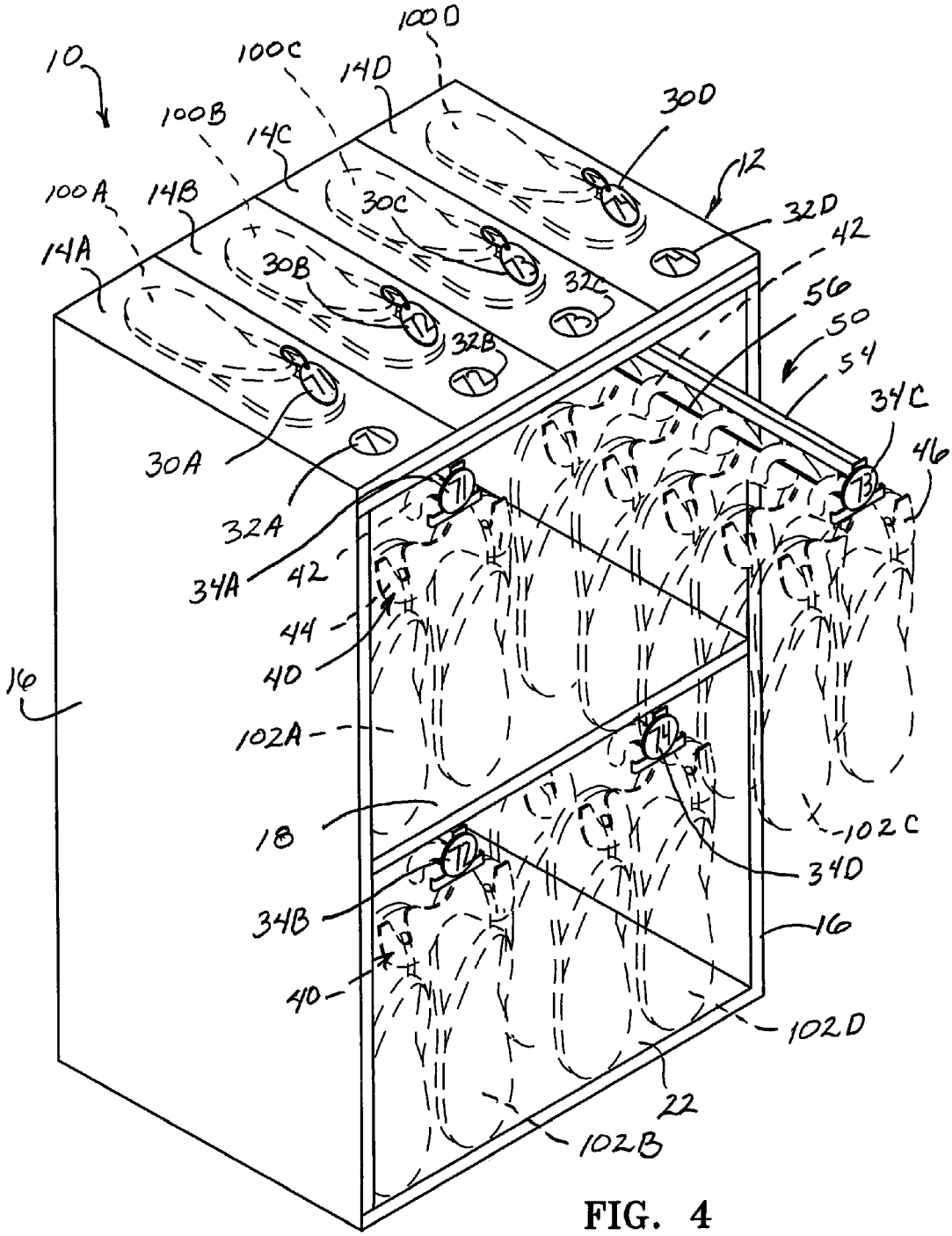
FIG. 4 is a perspective view of the cabinet of FIG. 2 showing one of the racks pulled forward to permit access to the footwear hanging from the rack.
Figure 5:
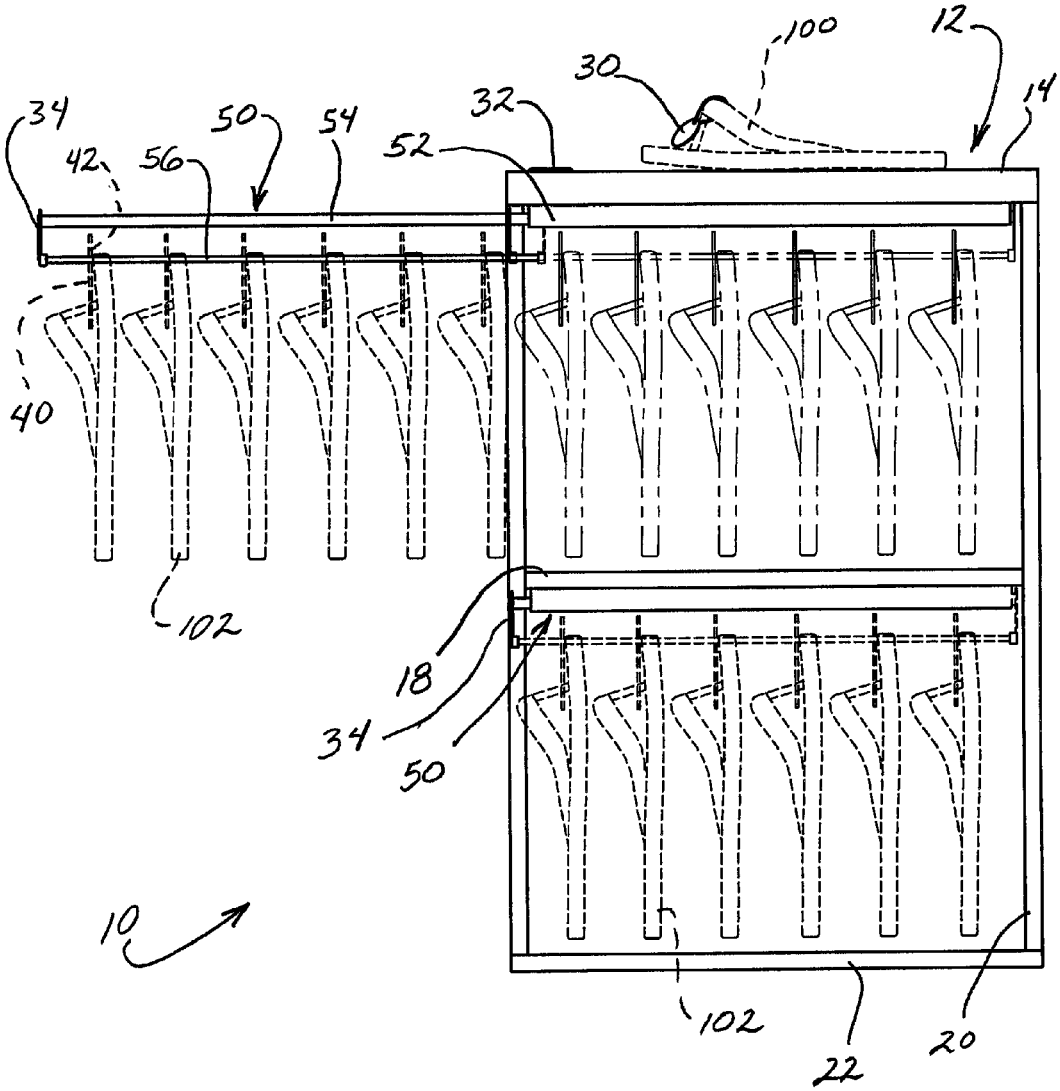
FIG. 5 is a left side view of the cabinet of FIG. 4 with the left sidewall removed.

For example, as illustrated in FIGS. 2-5, the cabinet 12 includes four sandal samples 100 with each sample having a tag 30 marked with identifying indicia 71-74. A shopper desiring to purchase a sandal style corresponding to the indicia 73 on the tag 30 will pull out the rack 50 having the tab marked with the indicia 73 (FIGS. 4-5). The shopper can then look through the inventory of sandals hanging from the rack to find his/her desired size. Once the desired size is located the shopper can then remove that sandal pair from the rack, try on the sandal and if satisfied with his/her selection, proceed to checkout.

As best illustrated in FIG. 3, each left and right sandal pair 102 is secured together by a hanger 40. The hanger 40 is preferably constructed of material such as cardboard or plastic with sufficient rigidity and strength to withstand repeated removal and re-hanging from the rack 50 without tearing or breaking. The hanger preferably 40 includes a large upper hook 42 which easily hooks onto a rod 56 (FIG. 5) on the rack 50. The hanger 40 also includes two lower hooks 44, 46 spaced laterally and in substantially the same plane to maintain the left and right sandals in a side-by-side relationship. This arrangement of the hanger 40 allows the shopper to quickly and easily remove the sandal pair from the pull-out rack 50, drop them to the floor and slip his/her left or right foot into the sandals to ensure proper fit and viewing of the sandal on the shoppers foot. If a different size or style is desired, the shopper can then easily re-hook the sandal pair back onto the proper rack 50.

Referring to FIGS. 4 and 5, the rack 50 preferably includes a stationary track 52 which is secured to the underside of the top surface 14 of the cabinet 12 and/or to the underside of a horizontal shelf 18. A movable rail 54 is supported by the track 52 by rollers, ball bearings or other mechanism (not visible) so as to preferably ensure the rail glides smoothly and easily along the track 52 as it is pulled out and pushed in by the shoppers. A rod 56 is spaced below the rail 54 a sufficient distance to ensure the large upper hook 42 of the hanger 40 will easily fit between the rail 54 and rod 56. The rack 50 preferably includes appropriate stops to prevent the rail 54 from being unintentionally pulled out of the track 52.

It should be appreciated that the foregoing system and method 10 allows the store to display a wide selection of merchandise samples to consumers. The system and method 10 also allows the store to maintain a large inventory of merchandise with minimal stockroom storage area. The system and method 10 further minimizes the number of employees necessary to serve customers because the system and method promotes self-service by the shopper by permitting the shopper to easily view and access the store's entire inventory. The system and method 10 also minimizes the number of employees necessary to maintain a neat store area by minimizing the need to pick up after shoppers since the hangers and racks promote the re-hanging of the inventory by the shopper after trying on the merchandise. Furthermore, the system and method 10 allows for a minimal number of employees to maintain an orderly store because shoppers can easily compare the tags 30 and buttons 32 to ensure the samples 100 are returned to the proper display area. In the event a shopper mistakenly places a sample 100 in the wrong display area, the misplaced sample is easily identifiable by the employee walking past the display area due to the mismatched tags and buttons. Similarly, the employees can quickly identify if any inventory 102 is running low by simply pulling out the racks 50 from the cabinet 12 or by watching as the shoppers pull out the racks 50. These same features and advantages of the system and method 10 also improve the shopping experience of consumers.

The foregoing description is presented to enable one of ordinary skill in the art to make and use the invention. Various modifications to the preferred embodiment, and the general principles and features described herein will be readily apparent to those of skill in the art. Thus, the present invention is not to be limited to the embodiments described above and illustrated in the drawing figures.

The invention claimed is:

1. A method of displaying merchandise for sale to consumers, comprising:

a cabinet having a top surface, a bottom and stationary sidewalls and a plurality of racks disposed below said top surface, said racks comprising a stationary track and a moveable rail supported by the track, said racks movable between a storage position and an extended position, said top surface having a plurality of display areas corresponding to said plurality of racks, each display area conspicuously marked with a unique identifying indicia, each rack conspicuously marked with indicia corresponding to one of said unique identifying indicia of said corresponding display areas;

placing a footwear sample within each of the respective display areas, each footwear sample having different features, and each footwear sample conspicuously marked with indicia corresponding to one of said unique identifying indicia of said corresponding display area and said corresponding rack;

extending the movable rail from the storage position to the extended position and removably hanging from the rack an inventory of footwear having the same features as said corresponding footwear sample in said corresponding display area.

2. The method of claim 1 wherein said unique identifying indicia comprises sequentially numbered digits.

3. The method of claim 1 wherein said footwear sample and said inventory of footwear comprises left and right footwear pairs.

4. The method of claim 3 wherein said footwear pairs are supported by hangers in a side-by-side relationship.

5. The method of claim 4 wherein said hangers each comprise an upper hook adapted to hook onto said rack and two lower hooks spaced laterally and in substantially the same plane to maintain said left and right footwear in said side-by-side relationship.

6. The method of claim 5 wherein said rack further comprises a rod spaced below said moveable rail a sufficient distance to receive said upper hook of said hanger.

7. The method of claim 3 wherein said footwear sample is a sandal and said left and right footwear pairs are left and right sandal pairs.

8. The method of claim 1 wherein a plurality of cabinets are arranged back-to-back.

9. The method of claim 3 wherein said inventory of footwear removably hanging from each of said plurality of racks includes different sizes of said footwear of the same style as said corresponding footwear sample in said corresponding display area.

10. A merchandise system for self-service by consumers, comprising:

a cabinet having a top surface, a bottom and stationary sidewalls and a plurality of racks disposed below said top surface, said racks comprising a stationary track and a moveable rail supported by the track said racks movable between a storage position and an extended position, said top surface having a plurality of display areas corresponding to said plurality of racks, each display area conspicuously marked with a unique identifying indicia, each rack conspicuously marked with indicia corresponding to one of said unique identifying indicia of said corresponding display areas;

a footwear sample displayed within each of the respective display areas, each footwear sample having different features, and each footwear sample conspicuously marked with indicia corresponding to one of said unique identifying indicia of said corresponding display area and said corresponding rack;

an inventory of footwear removably hanging from each of said plurality of racks having the same features as said corresponding footwear sample in said corresponding display area;

whereby a consumer viewing a desired one of said footwear samples on display can locate said corresponding inventory of footwear by matching said identifying indicia on said desired footwear sample with said identifying indicia marking said rack from which said inventory of footwear corresponding to said desired footwear sample removably hangs.

11. The system of claim 10 wherein said unique identifying indicia comprises sequentially numbered digits.

12. The system of claim 10 wherein said footwear sample and said inventory of footwear comprises left and right footwear pairs.

13. The system of claim 12 wherein said footwear pairs are supported by hangers in a side-by-side relationship.

14. The system of claim 13 wherein said hangers each comprise an upper hook adapted to hook onto said rack and two lower hooks spaced laterally and in substantially the same plane to maintain said left and right footwear in said side-by-side relationship.

15. The system of claim 14 wherein said rack further comprises a rod spaced below said moveable rail a sufficient distance to receive said upper hook of said hanger.

16. The system of claim 12 wherein said footwear sample is a sandal and said left and right footwear pairs are left and right sandal pairs.

17. The system of claim 12 wherein said inventory of footwear removably hanging from each of said plurality of racks includes different sizes of said footwear of the same style as said corresponding footwear sample in said corresponding display area.

18. The system of claim 10 wherein a plurality of cabinets are arranged back-to-back.

* * * * *